United States Patent [19]

Willenbring

[11] Patent Number: 4,516,386

[45] Date of Patent: May 14, 1985

[54] SEMI-AUTOMATIC SLIDE MOUNTER WITH ANTI-REVERSE OPERATING LEVER

[75] Inventor: Armer J. Willenbring, Bloomington, Minn.

[73] Assignee: Pako Corporation, Minneapolis, Minn.

[21] Appl. No.: 144,284

[22] Filed: May 9, 1980

[51] Int. Cl.[3] ..... B65B 63/00

[52] U.S. Cl. ..... 53/520; 53/390

[58] Field of Search ..... 53/390, 570, 520; 74/575, 576, 578, 526

[56] References Cited

U.S. PATENT DOCUMENTS

| | | | |
|---|---|---|---|
| 739,583 | 9/1903 | Bryson | 74/576 |
| 964,077 | 7/1910 | Williams | 53/520 |
| 1,862,188 | 6/1932 | Legge | 74/576 |
| 2,001,810 | 5/1935 | Zwald | 74/576 |
| 3,974,978 | 8/1976 | Henze | 74/576 |
| 4,055,933 | 11/1977 | Getsch | 53/570 |
| 4,102,029 | 7/1978 | Thompson | 53/520 X |
| 4,130,271 | 12/1978 | Merriman | 74/575 X |

OTHER PUBLICATIONS

"Operating Instructions for Semi-Automatic Mounters", Aug. 1977–For Types 6001 and 7004 by Geimuplast Peter Moundt KG.

*Primary Examiner*—John Sipos

*Attorney, Agent, or Firm*—Kinney & Lange

[57] ABSTRACT

A photographic slide mounter cuts photographic film transparencies from a photographic film strip and inserts the transparencies into slide frames. The slide mounter includes a slide advance device which advances a slide frame from a slide holder along a slide track to a position where an insertion opening in the slide frame is widened. The film strip is advanced by a film advance device, which inserts the transparency into the insertion opening in the slide frame. The transparency is then severed from the strip by a knife. As the next slide is advanced from the slide holder along the slide track, it ejects the previous slide. During ejection of the previous slide, the severed transparency is inserted the final distance into the slide frame to align the photographic image on the transparency with the aperture in the slide frame. Operation of the slide advance device, film advance device, and the knife is achieved by an operating lever which is movable by an operator in a first direction through a closed path during an operating cycle. An anti-reverse mechanism prevents the operating lever from moving in a second, reverse direction in the closed path, and therefore prevents jamming and destruction of film caused by accidental reversal of motion of the operating lever.

9 Claims, 13 Drawing Figures

SEMI-AUTOMATIC SLIDE MOUNTER WITH ANTI-REVERSE OPERATING LEVER

BACKGROUND OF THE INVENTION

1. Field of the Invention

The present invention relates to photographic slide mounting apparatus.

2. Description of the Prior Art

Photographic slides are produced by mounting a photographic film transparency in a slide mount frame so that the image of the photographic transparency is aligned with the aperture of the frame. A variety of different types of mounting frames and mounting apparatus have been developed.

One particularly advantageous type of photographic slide mount is the Pakon slide mount, which is a one-piece plastic slide mount sold by Pako Corporation, the assignee of the present application. The film transparency is mounted by opening a film insertion slot in the slide mount by means of mounting equipment. The transparency slides into the mount and the mount is closed. The spring-like properties of the plastic slide mount material provides a safe and tight fit of the transparency in the slide mount without the need of welding or sealing.

U.S. patents showing slide mounts and slide mounting apparatus of this general type include the following patents:

Florjancic et al—U.S. Pat. No. 3,341,960
Mundt et al—U.S. Pat. No. 3,470,642
Mundt et al—U.S. Pat. No. 3,478,456
Mundt et al—U.S. Pat. No. 3,524,299
Mundt et al—U.S. Pat. No. 3,562,074
Mundt—U.S. Pat. No. 3,570,342
Mundt et al—U.S. Pat. No. 3,614,854
Florjancic—U.S. Pat. No. 3,788,031
Mundt et al—U.S. Pat. No. 3,807,121
Mundt et al—U.S. Pat. No. 3,943,029
Mundt et al—U.S. Pat. No. 3,977,280
Urban—U.S. Pat. No. 4,004,340
Urban et al—U.S. Pat. No. 4,135,343

Apparatus has been developed for both manual and automatic mounting of transparencies in Pakon slide mounts. The manual mounting procedure utilizes a handheld mounting device into which the slide mount is inserted. By grasping the mount and the mounter together at one side, the film insertion opening is widened to permit insertion of a transparency in the slide mount. The transparency has previously been cut from a strip of photographic film containing many individual transparencies and is inserted manually into the slide mount.

While the hand mounting apparatus and procedure is adequate for mounting small quantities of transparencies in slide mounts, it clearly is not suitable for large-scale production of mounted transparencies as is required in professional photofinishing laboratories. The Pakon Slide Mounter sold by Pako Corporation is an automatic, motor-driven apparatus which mounts photographic film transparencies in Pakon slide mounts at rates of up to 160 slides per minute.

In some cases, however, the quantity of slides to be mounted by a photofinishing laboratory is not large enough to justify the use of automatic slide mounting apparatus such as the Pakon Slide Mounter, yet is greater than that which can be efficiently performed manually. To meet this need, semi-automatic slide mounters have been developed, such as the Type 6001 and 7004 slide mounters developed by Geimuplast Peter Mundt KG. These semi-automatic slide mounters operate generally in a similar manner to the automatic Pakon Slide Mounter, but are driven by an operating handle which is moved by the operator, rather than being motor driven.

The Type 6001 and 7004 semi-automatic slide mounters are operated by moving the operating lever along a closed path through an operating cycle. During this cycle, the following five functions are performed. First, an insertion slot in a slide mount is widened to receive the transparency. Second, the film strip is advanced and inserted into the mount. Third, the transparency is severed from the remainder of the film strip. Fourth, the transparency is inserted completely into the slide mount. Fifth, the mounter ejects the mounted slide.

These five functions form a complete mounting cycle. The home position of the operating lever occurs between the second and third functions. The path of the operating handle during an operating cycle begins with a first path portion in which the handle is moved downward from the home position. During this first path portion of the cycle, the knife cuts the transparency from the film strip. The second portion of the path of the operating handle is a movement toward the operator. During this second path portion, the transparency is inserted completely into the mount, a new mount is advanced from a slide mount holder so as to eject the mounted slide, and the insertion slot of the new slide mount is widened to receive another transparency from the film strip. The third portion of the path of the operating handle involves an upward movement of the handle which causes the film cutter blade to be retracted. During the fourth and final portion of the path, the operating handle is moved away from the operator and back to the home position. During this fourth path portion, the film strip is advanced to insert a transparency at the end of the film strip into the slide mount.

SUMMARY OF THE INVENTION

The present invention is an improved semiautomatic slide mounter apparatus which is driven by an operator lever means which is movable through a closed path to provide operation of a slide advance means, a film advance means, and a knife means during an operating cycle. The slide advance means advances a slide frame from a slide holder means along a slide track. The film advance means feeds the transparency, while still an integral portion of a film strip, into an insertion opening of the slide frame. The knife means severs the transparency from the strip.

In the apparatus of the present invention, anti-reverse means permit the operating lever means to move in a first direction through the closed path to provide operation of the slide advance means, the film advance means, and the knife means during an operating cycle, but prevents the operating lever means from moving in a second reverse direction in the closed path. The anti-reverse means, therefore, prevents jamming of the apparatus or damage to the photographic film due to inadvertent reversal of the movement of the operating lever means.

DETAILED DESCRIPTION OF THE PREFERRED EMBODIMENTS

Figure 1:
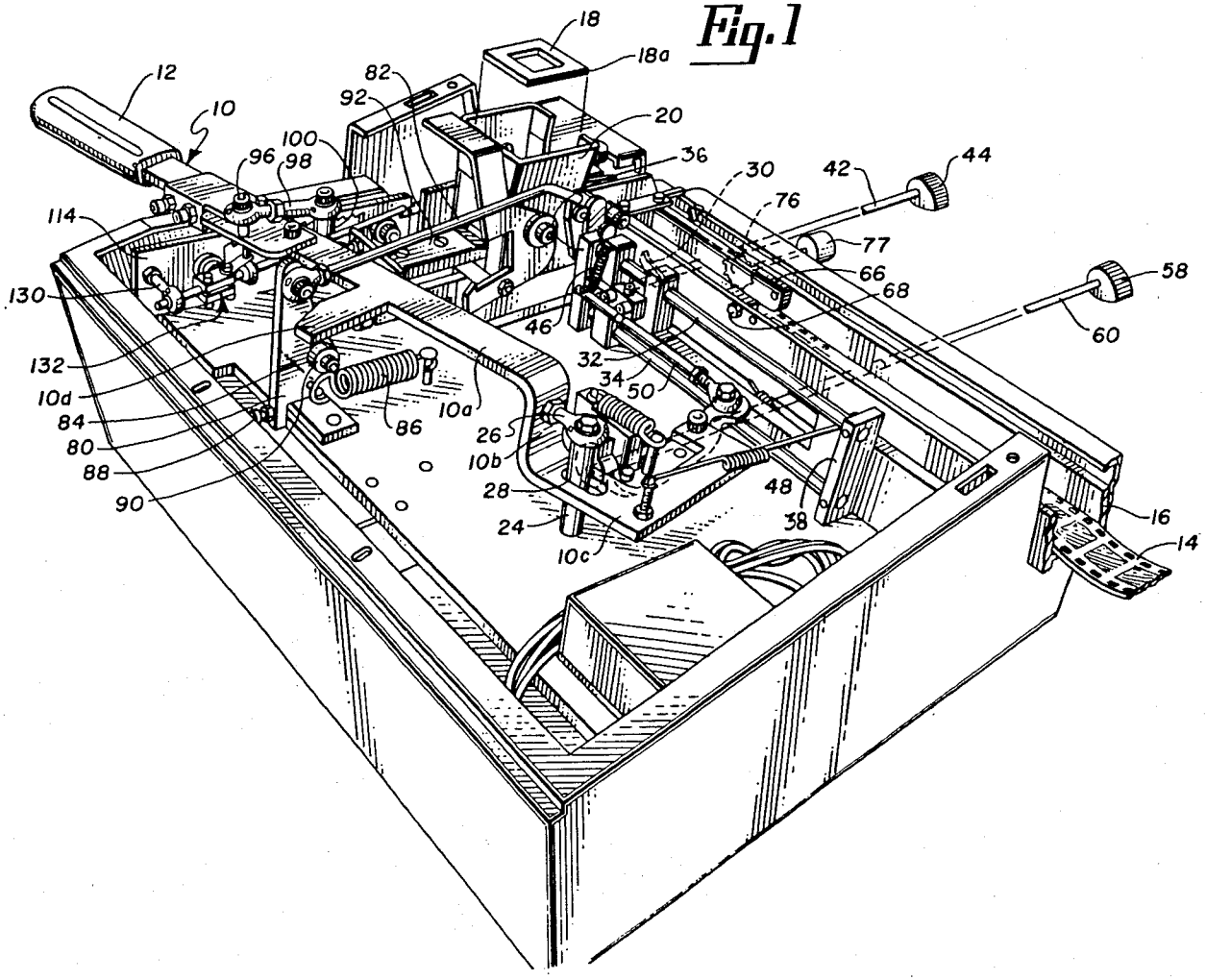
FIG. 1 is a pictorial view in perspective of the slide mounter of the present invention with top cosmetic cover removed.
Figure 2A:
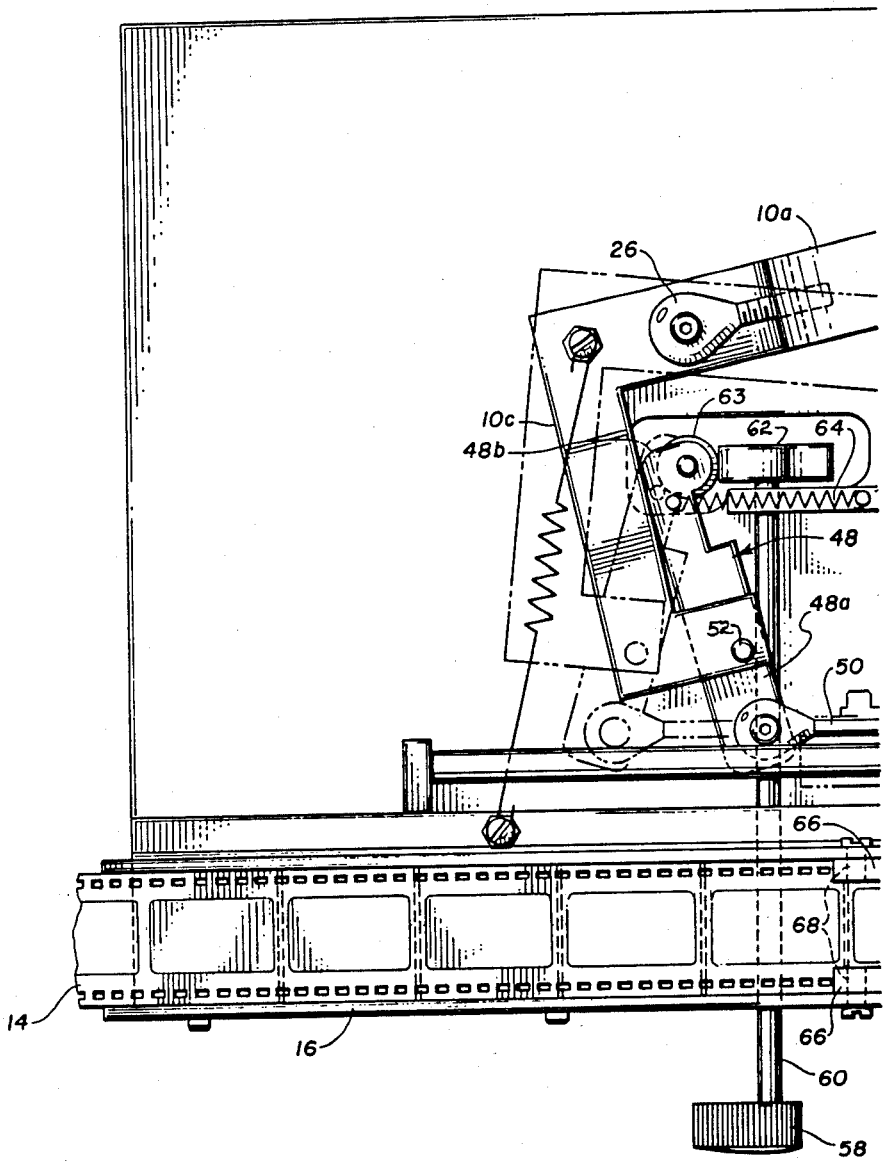
FIGS. 2*a* and 2*b* are a top plan view of the slide mounter of FIG. 1 with the side and bottom covers removed, parts broken away, and some elements shown in phantom line position
Figure 2B:
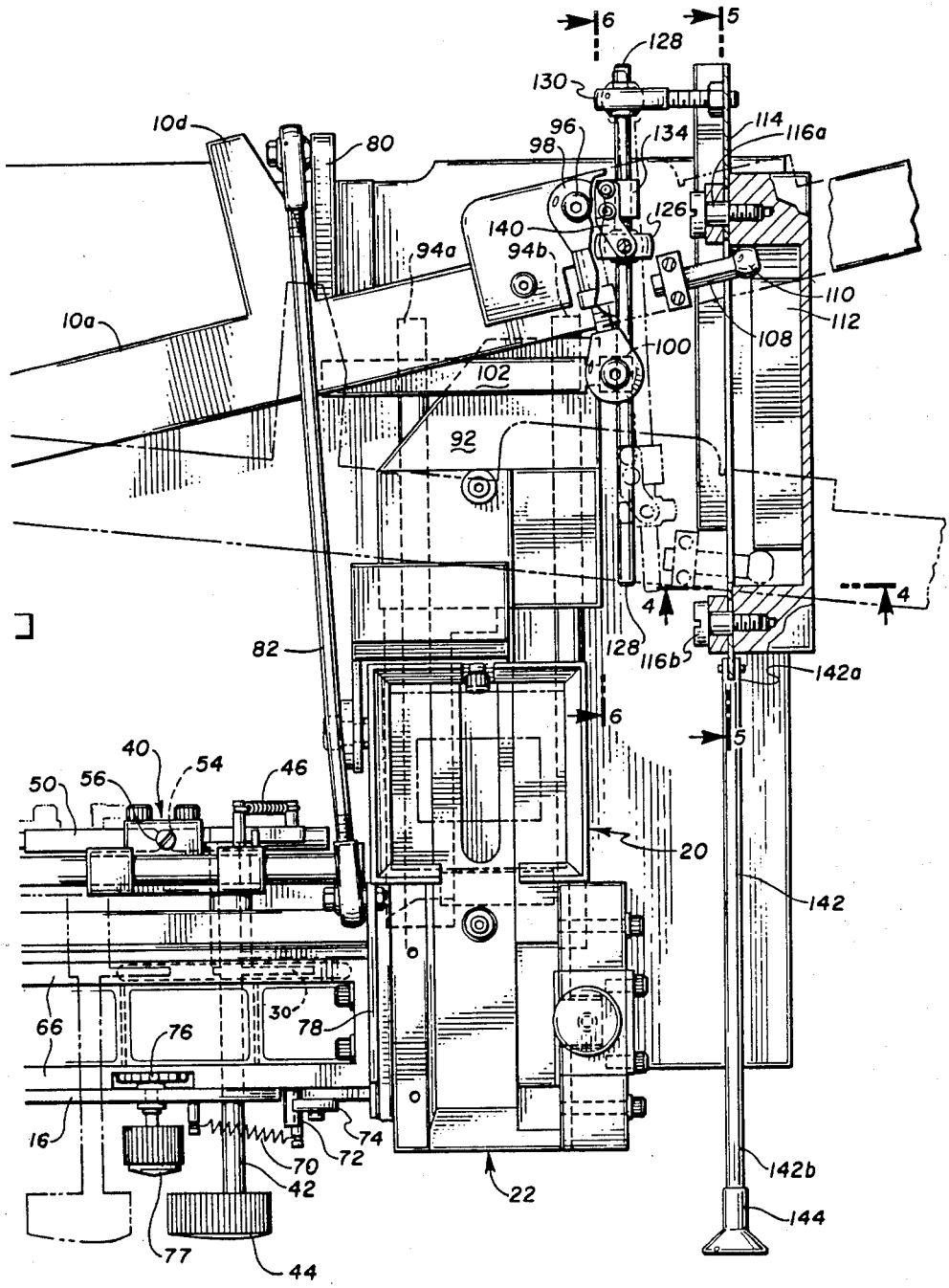
Figure 3:
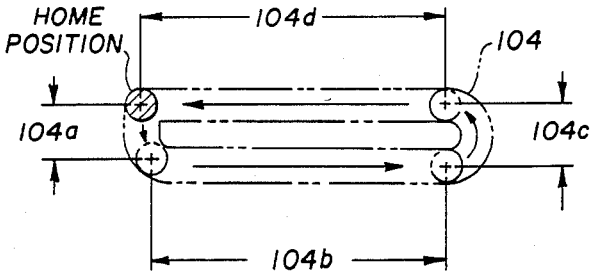
FIG. 3 is a schematic representation of the path of the operating lever and functions performed by the slide mounter of FIGS. 1 and 2 during an operating cycle.

FIGS. 1 and 2 show a semi-automatic slide mounter which utilizes the anti-reverse mechanism of the present invention. In the embodiments shown in FIGS. 1 and 2, the slide mounter is actuated by operating lever 10, which has a handle 12 at its outer end. The operator grasps handle 12, and moves handle 12 (and lever 10) through a cycle illustrated schematically in FIG. 3.

The perspective view of the slide mounter shown in FIG. 1 is viewed from the left rear corner of the slide mounter. FIG. 2, on the other hand, is a top view (in two halves) in which the front of the slide mounter is shown in the lower portions and the rear is shown at the upper portions of the drawings. In the schematic illustration of the movements of handle 12 and operating lever 10 shown in FIG. 3, the movements are viewed from the left side of the slide mounter.

Operating lever 10 controls, through various linkage members, three major operating mechanisms of the slide mounter. The first mechanism is the film advance mechanism, which advances film web 14 along film track 16. The second mechanism is the knife actuating mechanism, which severs a transparency from film web 14. The third mechanism is the slide advance mechanism, which advances slide mount 18 from slide magazine 20 along slide track 22 (FIG. 2). As slide 18 is advanced, an insertion opening along edge 18*a* of slide 18 is opened up to permit insertion of a transparency into slide 18.

(1) The Film Advance Mechanism

Lever 10 is pivotally connected to upstanding post 24 by universal link connection 26. Lever 10 has a first generally straight portion 10*a* to which handle 12 is connected at one end. At the opposite end of portion 10*a*, lever 10 has a downward turned portion 10*b*. Connecting link 26 is connected to portion 10*b*. Lever 10 has a third portion 10*c* which extends from downturned portion 10*b* and is generally parallel to portion 10*a*. Portion 10*c* has a general C-shape. Post 24 extends through slot 28 in lower portion 10*c* of lever 10.

The film advance mechanism of the slide mounter of FIGS. 1 and 2 is connected to and driven by lower portion 10*c* of lever 10. The film advance mechanism includes film advance pawl 30, which is movable along a path parallel to film track 16. Pawl 30 engages sprocket holes in film 14 to move film 14 along track 16.

The path of movement of film advance pawl 30 is defined by guide rods 32 and 34, which are parallel to one another and are supported at their ends by upstanding support members 36 and 38. Guide block assembly 40 is movable on guide rods 32 and 34. Film advance pawl 30 is connected to shaft 42, which is pivotally connected to guide block assembly 40. At one end of shaft 42 is pawl release lever 44, which permits the operator to turn shaft 42, and thereby move pawl 30 out of engagement with film 14. At the opposite end of shaft 42 is bias spring 46, which biases shaft 42 and pawl 30 to a normal position in engagement with sprocket holes in film 14.

As guide block assembly 40 is moved on guide rods 32 and 34, shaft 42 and film advance pawl 30 also are moved. Guide block assembly 40 is connected to lever 10 through arm 48 and connecting link 50. Arm 48 is pivotally connected near its center to lower arm portion 10*c* by connector 52. In addition, arm 48 is pivotally connected at first end 48*a* to an end of connecting link 50. Near its opposite end, connecting link 50 has a notch 54 which is engaged by ball plunger 56 connected to guide block 40. Ball plunger 56 normally engages notch 54 so that guide block assembly 40 moves with the movement of connecting link 50. If, however, the resistance to forward movement of film 14 is so great that there is a danger of pawl 30 tearing the sprocket holes of film 14, ball plunger assembly 56 releases notch 54 so that guide block assembly 40 and pawl 30 are disconnected from connecting link 50.

The distance that film 14 is advanced is adjusted by film framing lever 58, which is connected to one end of shaft 60. Cam 62 is connected to the opposite end of shaft 60, and rotates with shaft 60 as lever 58 is moved. Second end 48*b* of arm 48 has a roller 63 rotatably mounted thereon which is held in contact with cam 62 by bias spring 64. The position of lever 58, therefore, dictates the position of cam 62, and thus the stroke of first end 48*a* of arm 48 and the stroke of connecting link 50.

FIG. 2 illustrates two positions of lever 10. In the position indicated by solid lines, guide block assembly 40 and pawl 30 are at the end of the film advancement (the "home position"), in a position similar to that shown in FIG. 1. In the position shown in phantom lines, guide block assembly 40 and pawl 30 have been moved back along track 16 to the beginning point of another film advancement. As can be seen from FIG. 2, the position of cam 62 controls the beginning and end positions of end 48*a* of arm 48, and thus the beginning and end positions of guide block 40 and pawl 30.

The film advance mechanism also includes film guide flap 66, which is pivotally connected to track 16 by pivot pins 68. Bias spring 70, pin 72, and pin engaging lock 74 hold film guide flap 66 in a normal position parallel to track 16. In its normal position, flap 66 presses film 14 downward against the rails of track 16, and thus keeps film 14 in engagement with film advancement pawl 30. If insertion of film 14 into mount 18 meets resistance which might lead to damage of the film, the upward force against pin 72 overcomes the spring bias of bias spring 70, and pin 72 is released by lock 74. As a result, the film flap 66 pivots upward about the axis defined by pivot pin 68. This permits film 14 to buckle and move out of engagement with pawl 30. Film insertion sprocket wheel 76 engages sprocket holes in film 14 and may be rotated by means of knob 77 to permit manual insertion of film 14 under film flap 66.

(2) The Knife Actuating Mechanism

The knife mechanism includes a pivoted knife blade 78, which cooperates with a fixed blade (not shown) to sever the film transparency from film strip 14. Knife blade 78 is positioned at the end of film track 16, where film track 16 meets slide track 22. Lever 10 operates knife 78 through lever arm 10*d*, upstanding knife actuating lever 80, and knife actuating link 82. Knife actuating lever 80 is pivotally mounted about pivot axis 84 (by mounting means which are not shown) and is held in normal upstanding position shown in FIG. 1 by bias spring 86, which is connected near the lower end of knife actuation lever 80. Link 82 is connected at one end to the upper end of lever 80, and is connected at its opposite end to knife 78. The upstanding normal position of lever 80 may be adjusted by adjusting screw 88, which is positioned near the lower end of lever 80.

To cut the transparency from film web 14, lever 10 is moved downward from the home position. Arm 10*d* moves downward and engages roller 90, which is connected to lever 80. This causes lever 80 to pivot about pivot point 84, with the upper end of lever 80 moving toward the forward portions of the slide mounter. As a result, link 82 drives knife 78 downward to sever the transparency from film strip 14. Knife 78 remains in the film cutting position until lever 10 and arm 10*d* move upward, so that roller 90 is no longer in egagement with arm 10*d*. At this point, bias spring 78 returns lever 80 to its normal position, and link 82 pivots knife 78 to its upward open position.

(3) The Slide Advance Mechanism

The slide advance mechanism advances a slide mount 18 from the bottom of slide magazine 20 along slide track 22. Slide mounts 18 are oriented so that edge 18*a* which faces film track 16 contains the insertion opening of slide mount 18. Slide mounts 18 are preferably of the type which are a plastic unitary structure with a lid and a lower portion welded together, ready for use in a slide projector. Slides 18 have an insertion slot along side 18*a* which is opened to receive the transparency.

As mount 18 is ejected from magazine 20 and advanced along slide track 22, edge 18*a* of the lower portion of mount 18 slides under a wedged ramp (not shown) and is bent downward. This creates an insertion slot between the lower portion and the lid allowing an opening ramp (not shown) to enter mount 18. As slide mount 18 moves forward along slide track 22, the opening ramp raises the lid, thereby opening the insertion slot sufficiently to permit the end of film 14 to be inserted into slide mount 18 without being scratched.

The slide mount advance mechanism includes actuator 92, which moves along a path defined by guide rails 94*a* and 94*b*. As shown in FIG. 2, the path defined by guide rails 94*a* and 94*b* is generally perpendicular to the path defined by film track 16. Slide actuator 92 is connected to and operated by lever 10 through upstanding post 96, connecting link 98, upstanding shaft 100, and connection plate 102.

As lever 10 moves along its path toward magazine 20, actuator 92 enters the lower portion of magazine 20 through an opening at the bottom of magazine 20. Actuator 92 pushes out slide 18 through another opening in the opposite side of magazine 20 and along slide track 22. As a slide is pushed by actuator 92 along slide track 22, it ejects a preceding slide which had been positioned in slide track 22 into a collecting basket (not shown).

(4) The Anti-Reverse Mechanism

Lever 10 operates in a closed path during each operating cycle. The path is shown schematically in FIG. 3, and is illustrated in further detail in FIGS. 4–12. The path of lever 10 is defined by track 104. A track follower mechanism includes a downwardly extending member 106 which is attached to lever 10, and an outward projecting member 108, which has one end 108*a* connected to downward extending member 106, and its opposite end 108*b* extending into track 104. Connected at the end 108*b* is follower ball 110.

The path of lever 10, as defined by track 104, is a closed path having four sections. The path of the lever starts at a home position, which is designated with a shaded ball in FIG. 3. The home position is also illustrated in the perspective view shown in FIG. 1 and in the solid line view shown in FIG. 2.

The path is generally rectangular, and is defined by the rectangular portion of track 104, together with the center bar portion 112 of track 104. As a result, the path defined by track 104 consists of four portions or segments: first end track 104*a*, lower track 104*b*, second end track 104*c*, and upper track 104*d*.

During the first portion of an operating cycle, lever 10 moves downward from the home position, and track follower ball 110 follows first end track 104*a*. During this first portion of the cycle, a brake (not shown) is applied on film strip 14 and knife 78 is driven downward to cut the transparency from the remaining portion of film strip 14.

During the second portion of the cycle, the track follower ball 110 moves along lower track 104*b*. During this second portion of the cycle, a slide mount 18 is pushed out of magazine 20 by actuator 92 and is advanced along slide track 22. As the slide mount 18 advances, the insertion opening along edge 18*a* is opened. The slide mount 18 being advanced out of magazine 20 and along slide track 22 ejects the previous slide from slide track 22. As the previous slide mount is being ejected, the severed transparency is pushed the final distance into that slide mount, and the insertion opening in the slide mount is permitted to close. Also during the second portion of the cycle, guide block 40 is moved back along slide rails 32 and 34, thereby retracting film pawl 30.

During the third portion of the cycle, the track follower ball 110 moves upward along second end track 104*c*. During this movement of lever 10, the brake is released and knife blade 78 is lifted.

During the fourth and final portion of the operating cycle, the track follower moves along upper track portion 104*d* back to the home position. Guide block 40 and pawl 30 are driven by connecting link 50 to advance the film strip 14. As a result, the end of film strip 14 is inserted into the insertion opening of slide mount 18 positioned along slide track 22 to receive the film. In addition, slide actuator 92 is retracted to its original position.

Upon returning to the home position, the mounter is ready for another operating cycle. The operator can verify the framing of the transparency to ensure that film strip 14 has been advanced by the proper amount. After verifying framing, the operator then commences another operating cycle by moving lever 10 downward from the home position, thereby cutting the transparency from the end of film strip 14.

The slide mounter of the present invention includes an anti-reverse mechanism which permits handle 10 to move in a first direction through the path defined by track 104, but prevents handle 10 from moving in a second, opposite direction. Movement of handle 10 in an opposite or reverse direction could, if permitted, cause damage to film 14 and result in jamming of the operating mechanisms.

In the preferred embodiment of the present invention shown in the Figures, the anti-reverse mechanism includes anti-reverse ratchet plate 114, which is mounted to track 104 by mounting pins (bolts) 116*a* and 116*b*. Ratchet plate 114 has diagonal slots 118*a* and 118*b* which cooperate with mounting pins 116*a* and 116*b*, respectively, so that ratchet plate 114 is slidable with respect to track 104.

Figure 4:
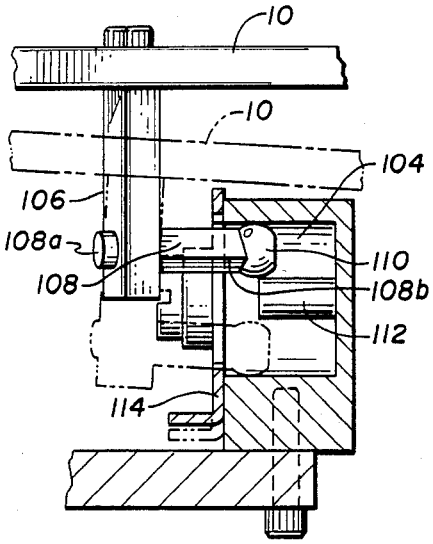
FIG. 4 is a sectional view of the anti-reverse mechanism of the slide mounter taken along line 4—4 of FIG. 2.
Figure 5:
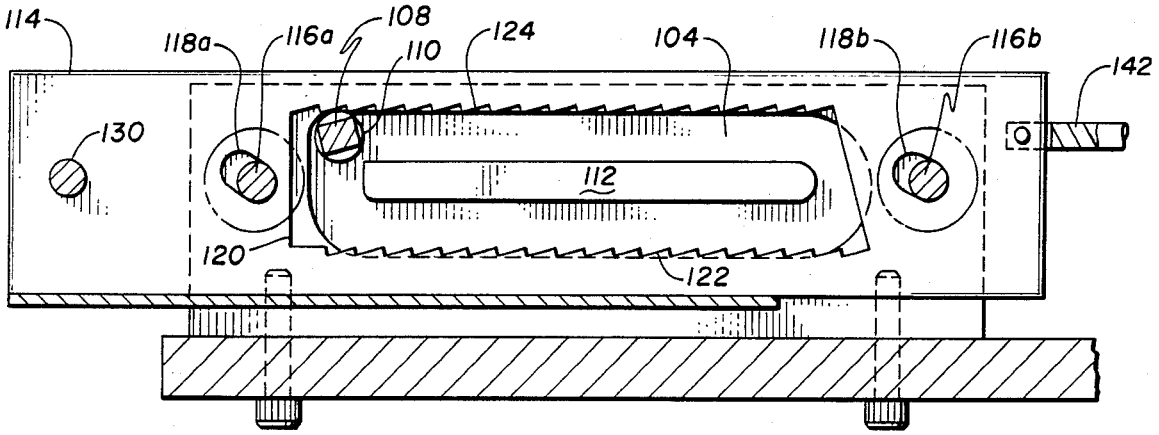
FIG. 5 is a sectional view of the anti-reverse mechanism taken along line 5—5 of FIG. 2.

As shown in FIGS. 4–12, ratchet plate 114 has an elongated trapezoidal opening 120 which overlays track 104. Outward projecting member 108 extends through opening 120, as best shown in FIG. 4. Positioned along the lower edge of opening 120 are ratchet teeth 122. A similar set of ratchet teeth 124 are positioned along the upper edge of opening 120. Ratchet teeth 122 and 124 are oriented so as to permit movement of outward projecting member 108 and track follower ball 110 in a first direction around track 104 as described previously. As will be described later in further detail, if the operator attempts to reverse the motion of lever 10, and thereby the motion of outward projecting member 108 and follower ball 110, ratchet teeth 122 or 124 engage a corner of outward projecting member 108, which has a generally rectangular cross-section as shown in FIG. 5.

The preferred embodiment of the anti-reverse mechanism of the present invention, as illustrated in the Figures, prevents reversal of motion of lever 10 without the annoying noise which often accompanies ratchet-type mechanisms. This noise is typically caused by the engagement of a member against the ratchet teeth when moving in the forward direction. In the present invention, ratchet plate 114 is slidable with respect to track 104 and is linked to lever 10 so that teeth 122 are maintained out of engagement with member 108 as long as lever 10 is moving in a forward direction along the lower track and keeps ratchet teeth 124 out of engagement with member 108 as long as lever 10 is moving in the forward or first direction along the upper track.

Ratchet plate 114 is linked to lever 10 by connecting link 126, rod 128, rod end 130, and friction device 132. Rod 128 extends through connecting link 126 and rod end 130. Ratchet plate 114 is connected to rod end 130, so that the position of ratchet plate 114 with respect to pins 116*a* and 116*b* and track 104 is controlled by the position and direction of movement of lever 10.

In the embodiment illustrated, friction device 132 includes block 134 of a plastic material such as Delrin plastic, bolts 136, nuts 138, and connecting link 140. Block 134 has a passage through which rod 128 passes, and a slot 134*a* which communicates with the passage. Slot 134*a*, bolts 136 and nuts 138 permit adjustment of the clamping of block 134 around rod 128, and thus the friction between block 134 and rod 128. Link 140 connects block 134 to link 126, and thus to lever 10.

Figure 6:
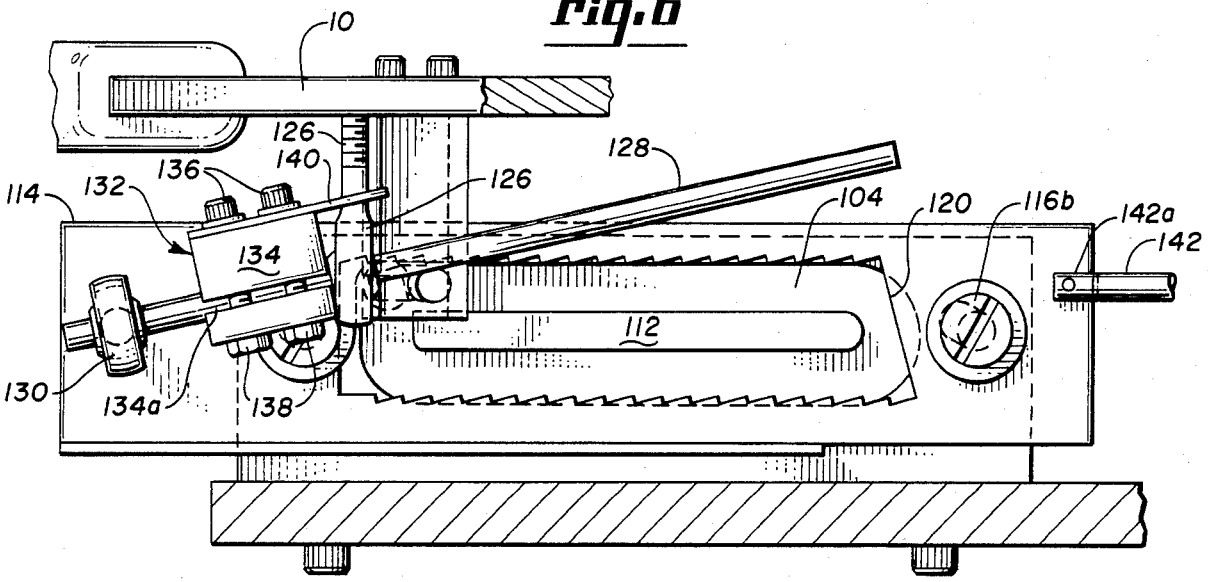
FIG. 6 is a sectional view showing further details of the anti-reverse mechanism of FIGS. 4 and 5 and taken along line 6—6 of FIG. 2.

FIGS. 5 and 6 illustrate the anti-reverse mechanism when lever 10 is at the home position. In this position, an upward force is applied to ratchet plate 114 through connecting link 126, rod 128 and rod end 130 so that the lower ends of diagonal slots 118*a* and 118*b* engage pins 116*a* and 116*b*. Ratchet plate 114, therefore, is in its uppermost position. As can be seen in FIGS. 5 and 6, in the uppermost position ratchet teeth 124 are located above upper track 104*d*. Ratchet teeth 122, on the other hand, are positioned above the lower edge of lower track 104*b*. The spacing between ratchet teeth 122 and 124 is less than the spacing between the lower edge of track 104*b* and the upper edge of track 104*d*, so that either teeth 122 or teeth 124 are in the path of the track at all times.

Figure 7:
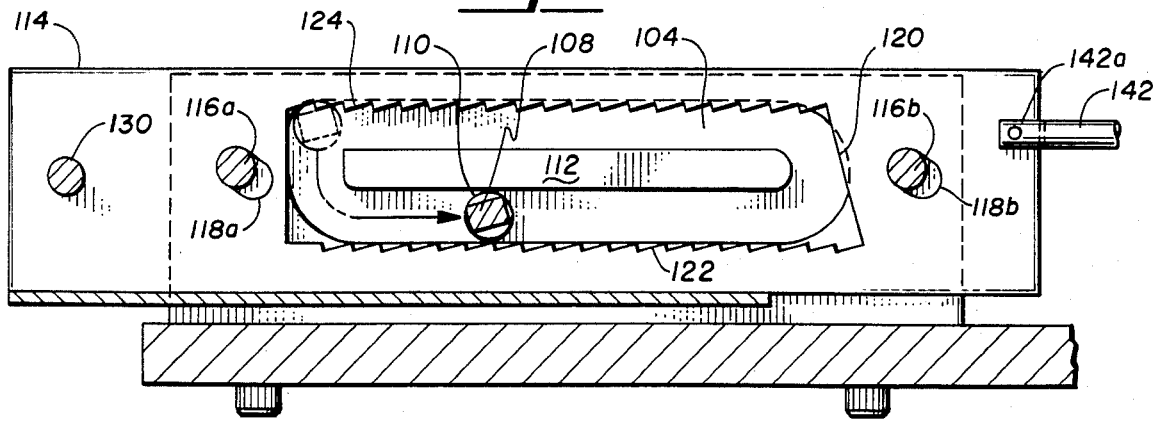
FIG. 7 is a sectional view with the elements of FIG. 5 at an advanced position along the lower track.
Figure 8:
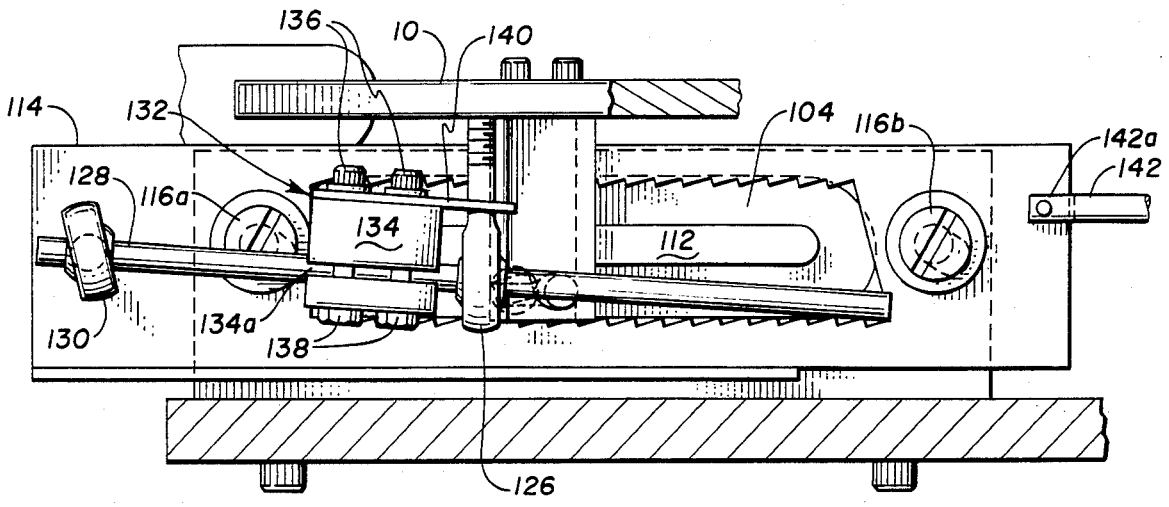
FIG. 8 is a sectional view with the elements of FIG. 6 shown at the same advanced position depicted in FIG. 7.

As the operating cycle begins, lever 10 moves downward from the home position through first end track 104*a*, and begins to move along lower track 104*b*, as shown in FIGS. 7 and 8. This downward motion of lever 10 applies a downward force through link 126, rod 128, and rod end 130 to ratchet plate 114. This causes ratchet plate 114 to slide diagonally downward until the upper ends of slots 118*a* and 118*b* engage pins 116*a* and 116*b*, respectively, as shown in FIG. 7. In this latter position, ratchet plate 114 is in its lowermost position, and ratchet teeth 122 are positioned below the lower edge of lower track 104*b*. As long as lever arm 10 continues to move in the proper direction along the lower track 104*b*, ratchet teeth 122 remain out of lower track 104*b*. As a result, no ratchet sound is produced, since ratchet teeth 122 do not engage member 108.

Figure 9:
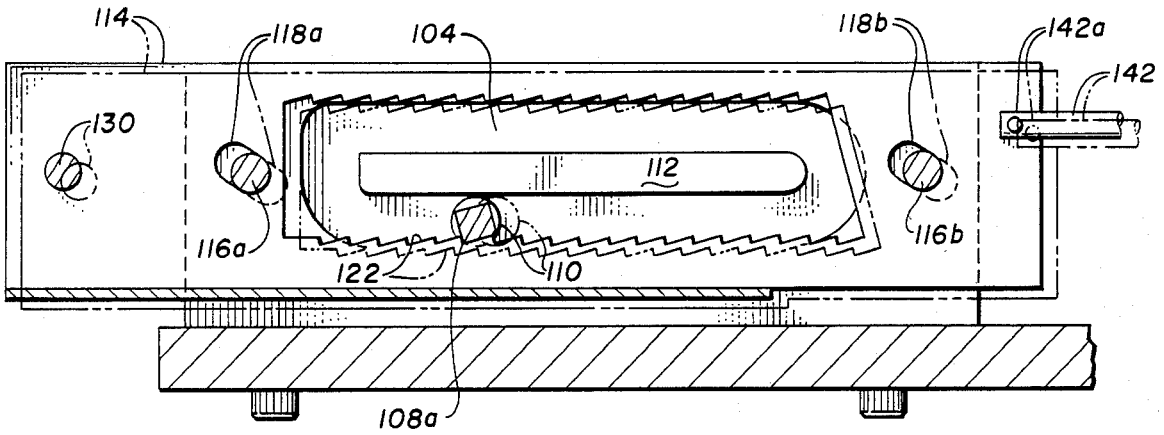
FIG. 9 is a sectional view with the elements of FIG. 5 at an advanced position along the lower track illustrating the mechanism in anti-reverse position when reverse movement of the operating lever is attempted.
Figure 10:
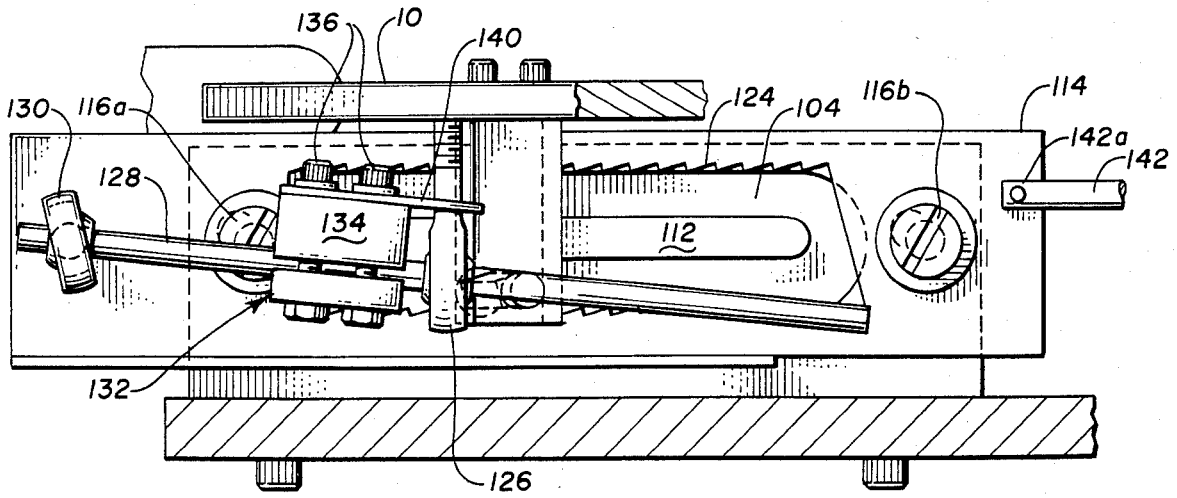
FIG. 10 is a sectional view with the elements of FIG. 6 further illustrating the anti-reverse position illustrated in FIG. 9.

FIGS. 9 and 10 illustrate operation of the anti-reverse mechanism when the operator attempts to move lever 10 in a reverse direction while moving along lower track 104*b*. The phantom lines shown in FIG. 9 illustrate the position before reversal of direction, while the solid lines indicate the position of components after reversal, with the components in the anti-reverse locking position.

As lever arm 10 begins to move in the reverse direction as illustrated in FIGS. 9 and 10, friction device 132 applies sufficient friction to rod 128 to apply an upward force to rod end 130 and ratchet plate 114. This causes ratchet plate 114 to slide to its uppermost position, with the lower ends of slots 118*a* and 118*b* engaging pins 116*a* and 116*b*, respectively. In this uppermost position, ratchet teeth 122 are drawn into the path of the lower track 104*b*, and prevent further reverse motion of member 108 by engaging the corner 108*a* of member 108.

When forward motion of lever 110 again begins, ratchet plate 114 is again driven downward to its lower position as shown in phantom in FIG. 9, and ratchet teeth 122 are again moved out of the path of member 108.

Figure 11:
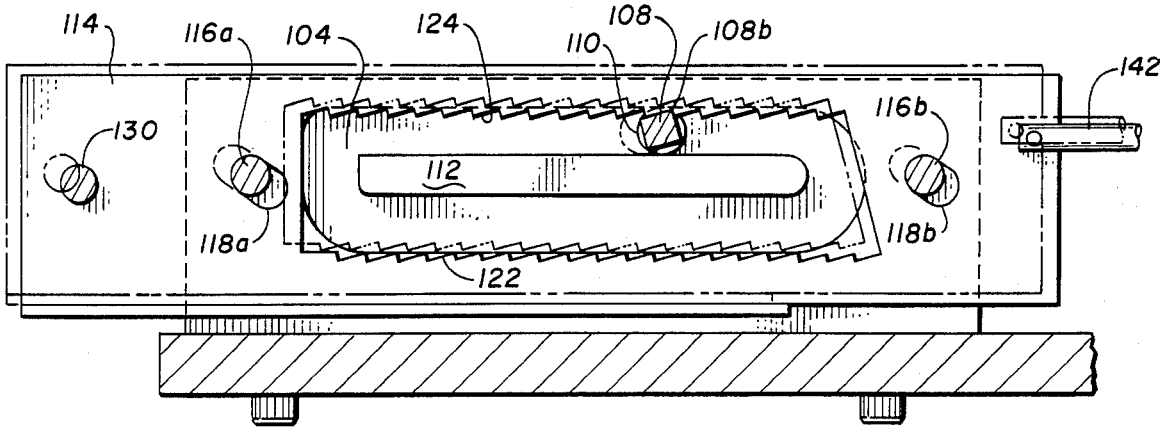
FIG. 11 is a sectional view with the elements of FIG. 5 at an advanced position along the upper track, and illustrating an anti-reverse position when operating lever movement is reversed.
Figure 12:
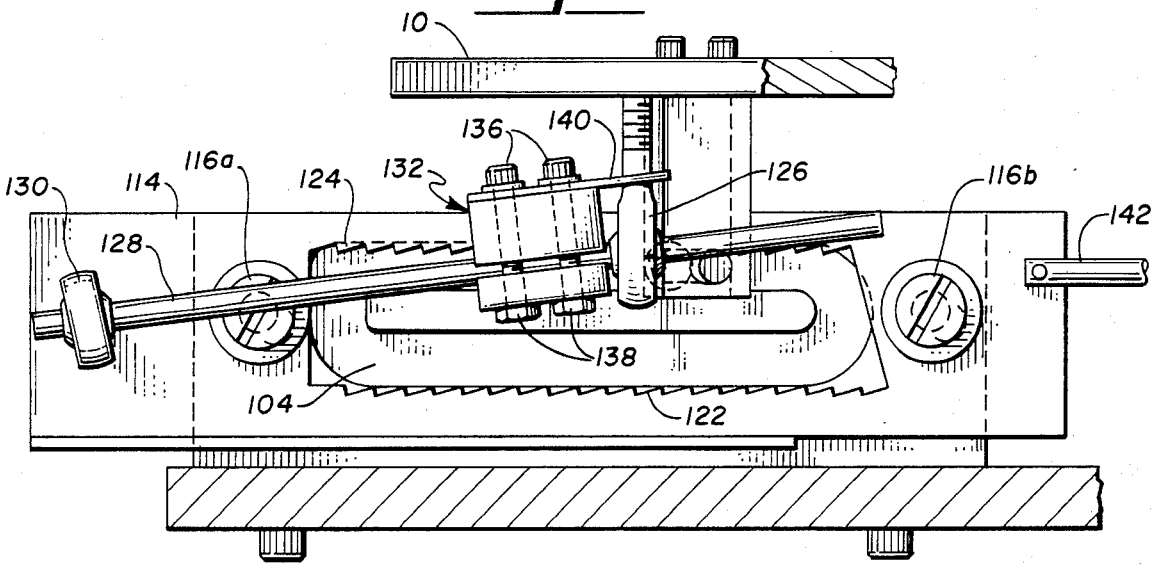
FIG. 12 is a sectional view with the elements of FIG. 6 at the position depicted in FIG. 11 and illustrating the anti-reverse position.

As lever 10 completes the travel along the lower track and moves upward along second end track 104*c*, an upward force is applied to ratchet plate 114 to move ratchet plate 114 from its lowermost to its uppermost position. As member 108 begins to move along the upper track portion 104*d*, ratchet teeth 124 are out of the path of member 108. FIGS. 11 and 12 illustrate operation of the anti-reverse mechanism as member 108 moves along upper track 104*d*. As long as lever 10 moves in the proper direction back toward the home position, ratchet plate 114 remains in its uppermost position with ratchet teeth 124 out of upper track 104*d* and out of engagement with member 108 (as shown in phantom). If, however, the operator attempts to reverse motion of lever 10 (as shown in solid lines), friction device 132 applies a sufficient frictional force to rod 128, rod end 130, and ratchet plate 114 to move ratchet plate 114 downward. This brings teeth 124 into engagement with corner 108*b* of member 108. Motion in the proper direction toward the home position results in a shifting of ratchet plate 114 upward, so that ratchet teeth 124 are again moved out of the path of member 108.

It can be seen, therefore, that the anti-reverse mechanism of the present invention prevents reverse movement of the lever 10 during those portions of the operating cycle in which film or slide movement is occurring. This prevents jamming and ultimate destruction of slides and/or film from occurring due to accidental reversal of motion of lever 10. The preferred embodiments of the present invention provide the further advantage of providing a ratchet-like anti-reverse motion without the noise often associated with ratchet mechanisms.

Although reverse movement of lever 10 must generally be prevented, the slide mounter of the present invention preferably includes a release mechanism which permits the anti-reverse locking to be released. Release rod 142 has one end 142*a* connected to the front end of ratchet plate 114. At an opposite end 142*b* of rod 142 is knob 144, which can be pushed or pulled by the operator to move ratchet plate 114 either up or down, as appropriate. In order to release the anti-reverse mechanism and permit movement of lever 10 away from the operator, the operator pulls knob 144 toward him. Conversely, when movement along the reverse direction toward the operator is desired, knob 144 is pushed away from the operator. In other words, in order to release the anti-reverse mechanism, knob 144 is moved in the opposite direction to the direction of desired movement of lever 10.

Conclusion

The present invention is an improved semi-automatic slide mounter which is operated by movement of an operator lever through a closed path during an operating cycle. Damage to film or slide mounts, or both, due to accidental reversal of motion of the operating lever is prevented by the anti-reverse mechanism of the present invention. The anti-reverse mechanism is simple, noiseless, and very effective. In the preferred embodiments, the anti-reverse mechanism may be released for those instances in which reverse motion is required to clear a jam or other malfunction which has occurred.

Although the present invention has been described with reference to preferred embodiments, workers skilled in the art will recognize that changes may be made in form and detail without departing from the spirit and scope of the invention.

What is claimed is:

1. An apparatus for mounting a photographic film transparency into a slide frame comprising:

slide holder means for holding a plurality of slide frames;

a slide track;

slide advance means for advancing a slide frame from the slide holder means along the slide track;

film advance means for feeding the transparency, while still an integral portion of a film web, into an insertion opening of the slide frame;

knife means for severing the transparency from the web;

operating lever means operatively connected to the slide advance means, the film advance means and the knife means, the operating lever means being movable in a first direction through a closed path having a plurality of path segments to provide operation of the slide advance means, the film advance means, and the knife means during an operating cycle; and anti-reverse means operably connected to the operating lever means for preventing the operating lever means from moving in a second, reverse direction in the closed path.

2. The apparatus of claim 1 and track means for defining the closed path; and track follower means connected to the operating lever means for following the path defined by the track means.

3. The apparatus of claim 2 wherein the anti-reverse means comprises ratchet means having ratchet teeth for engaging the track follower means when the operating lever moves in the second, reverse direction.

4. The apparatus of claim 3 wherein the ratchet means comprises a ratchet plate slidably connected to the track means; and linkage means for linking the ratchet plate and the operating lever means, the linkage means maintaining the ratchet teeth of the ratchet plate out of engagement with the track follower means when the operating lever means moves in the first direction and slides the ratchet plate to a position in which the ratchet teeth engage the track follower means when the lever moves in the second reverse direction.

5. The apparatus of claim 4 wherein the track means has a first generally vertical endtrack portion, a generally horizontal lower track portion, a generally vertical second end track portion, and a generally horizontal upper track portion.

6. The apparatus of claim 5 wherein the ratchet plate has a lower row of ratchet teeth proximate the lower track and an upper row of ratchet teeth proximate the upper track.

7. The apparatus of claim 6 wherein the linkage means moves the ratchet plate upward to bring the lower row of ratchet teeth in engagement with the track follower means when the operating lever is moved in the second reverse direction while the track follower is moving in the lower track; and wherein the linkage means slides the ratchet plate downward to bring the upper roller teeth in engagement with the track follower means when the operating lever means is moved in the second reverse direction while the track follower means is moving in the upper track.

8. The apparatus of claim 7 wherein the ratchet plate has a pair of parallel slots, and wherein a pair of mounting pins connected to the track means extend through the slots to mount the ratchet plate in slidable relation to the track means.

9. The apparatus of claim 8 wherein the parallel slots are oriented at a diagonal with respect to the upper and lower track portions.

* * * * *